US009777510B2

(12) United States Patent
Moller

(10) Patent No.: US 9,777,510 B2
(45) Date of Patent: Oct. 3, 2017

(54) TAMPER SWITCH ACTIVATION WITHOUT POWER

(75) Inventor: Per Kristian Moller, Moss (NO)

(73) Assignee: ASSA ABLOY AB, Stockholm (SE)

( * ) Notice: Subject to any disclaimer, the term of this patent is extended or adjusted under 35 U.S.C. 154(b) by 649 days.

(21) Appl. No.: 13/040,201

(22) Filed: Mar. 3, 2011

(65) Prior Publication Data

US 2012/0223836 A1 Sep. 6, 2012

(51) Int. Cl.

| | |
|---|---|
| ***G08B 21/00*** | (2006.01) |
| ***E05B 39/00*** | (2006.01) |
| ***E05B 47/00*** | (2006.01) |
| ***E05B 65/00*** | (2006.01) |
| ***E05G 1/00*** | (2006.01) |
| *E05G 1/04* | (2006.01) |

(52) U.S. Cl.

CPC ..... *E05B 39/00* (2013.01); *E05B 47/00* (2013.01); *E05B 65/0075* (2013.01); *E05G 1/005* (2013.01); *E05B 2047/0058* (2013.01); *E05G 1/04* (2013.01)

(58) Field of Classification Search

CPC ..... E05B 2047/0058; E05B 39/00; E05B 65/0075; E05B 47/00; E05G 1/005; E05G 1/04

USPC ..... 340/5.1, 5.2, 5.3, 5.31, 5.32, 524, 525, 340/542; 70/277, 278.1, 280

See application file for complete search history.

(56) References Cited

U.S. PATENT DOCUMENTS

| | | | | |
|---|---|---|---|---|
| 2,492,432 | A | 12/1949 | Laford | |
| 3,851,227 | A | 11/1974 | Hedin | |
| 4,654,642 | A | 3/1987 | Groff | |
| 5,012,075 | A | 4/1991 | Hutchison et al. | |
| 5,049,855 | A | 9/1991 | Slemon et al. | |
| 5,493,279 | A * | 2/1996 | Dawson et al. | 340/5.32 |
| 5,675,321 | A | 10/1997 | McBride | |
| 5,892,900 | A | 4/1999 | Ginter et al. | |
| 5,973,624 | A * | 10/1999 | Miller et al. | 341/35 |
| 5,986,563 | A * | 11/1999 | Shapiro | 340/5.55 |
| 2010/0031714 | A1 * | 2/2010 | Brown et al. | 70/91 |
| 2011/0110171 | A1 * | 5/2011 | Kamp et al. | 365/189.16 |

FOREIGN PATENT DOCUMENTS

| | | |
|---|---|---|
| CN | 2200042 | 6/1995 |
| CN | 1529030 | 9/2004 |
| CN | 1826729 | 8/2006 |
| CN | 101371231 | 2/2009 |
| CN | 101467188 | 6/2009 |
| CN | 201695861 | 1/2011 |

(Continued)

OTHER PUBLICATIONS

Product Data for Signature by VingCard, "Design Your Security: Signature Standard Range," VingCard Elsafe, Dec. 2009, 4 pages.

(Continued)

*Primary Examiner* — Mark Rushing
(74) *Attorney, Agent, or Firm* — Sheridan Ross P.C.

(57) ABSTRACT

A tamper-detection device and system are disclosed. The tamper-detection device includes one or more components which enable the tamper-detection device to detect a state change, even in the absence of a power supply. A capacitor is provided in the tamper-detection device that, when shorted, discharges and induces a state change at a micro-controller of the tamper-detection device.

16 Claims, 7 Drawing Sheets

(56) References Cited

FOREIGN PATENT DOCUMENTS

| | | |
|---|---|---|
| EP | 0402539 | 12/1990 |
| GB | 892198 | 3/1962 |
| GB | 2262923 | 7/1993 |
| WO | WO 90/07759 | 7/1990 |
| WO | WO 00/13083 | 3/2000 |
| WO | WO 03/040839 | 5/2003 |

OTHER PUBLICATIONS

Official Action (with English translation) for Chinese Patent Application No. 201110110183.9 dated May 6, 2014, 17 pages.

* cited by examiner

TAMPER SWITCH ACTIVATION WITHOUT POWER

FIELD OF THE DISCLOSURE

The present disclosure relates generally to security systems and more specifically relates to tamper detection systems.

BACKGROUND

Multi-room facilities such as hotels and cruise ships and similar structures often provide individual safes, and other secure amenities in each guest's personal area, including the guest's room itself. Other secured and/or monitored amenities also may be found in apartment buildings, office complexes, dormitories, office buildings, classrooms and laboratory facilities. For example, all of these facilities may provide electronic door locks which limit access to specific areas only to authorized persons. It is also common practice to equip these amenities with tamper-detection switches. In some instances (e.g., with in-room safes or door locks), the tamper-detection switches help provide guests or users of the amenity with additional guarantees of security by helping to detect whether or not someone has been tampering with the electronics of the amenity, such as a safe, for the purpose of gaining access to the amenity at a later time. In other instances, the tamper-detection switches are used to detect when an amenity has been accessed by a guest or user, such as a mini-bar, as this information may be required for billing purposes. In such instances, someone may have incentive to tamper with the electronics in an attempt to avoid detection of his or her use of the amenity. In any event, tamper-detection switches are well known and commonly used in a number of areas, even outside the multi-room facility markets.

Normally, the amenities are off-line and are battery powered. Typically, the tamper function of a tamper-detection switch does not work if the power to the safe or door lock is removed. In such case, someone may gain access to and tamper with the electronics without detection. For example, in the case of a safe, the electronics are positioned on the inside of the door of the safe, behind a cover or panel. When the cover is removed, thereby exposing the electronics, a tamper switch will normally be activated. However, if power is terminated before removing the cover, such as by removing the power supply (e.g., batteries) first, the tamper switch may not be activated. The electronics may then be altered and the cover returned to its normal position, without activation of the tamper switch. Power may then be restored without detection of the tampering.

Another shortcoming of many tamper-detection switches is the occurrence of false positive conditions. Specifically, some tamper-detection switches will become activated if the power supply is interrupted, such as when the batteries are removed or replaced. This often results in the device protected by the tamper switch entering into a "service mode." While in "service mode" the device protected by the tamper-detection switch is often rendered inoperable and made unavailable unless and until the tamper-detection switch is reset, for example, with a service device. In a large multi-room facility, a long amount of time may pass before an authorized person, such as a system administrator, is able to reset a tamper-detection switch that is in "service mode." This is undesirable to guests of the multi-room facility who want immediate access to and continuous normal operation of the amenity or device protected by the tamper-detection switch.

Another problem with many existing tamper-detection switches is that the repeated occurrence of false positive conditions (e.g., due to routine battery replacement) can result in improper treatment of situations where the actual tamper may have occurred. In other words, if false positive conditions are ignored, there is a risk that true positive conditions will also be ignored.

The following table summarizes the current state of the art with respect to tamper detection.

| | Power/ batteries | Tamper switch activated | Conclusion about tamper switch activation | Reported | Action |
|---|---|---|---|---|---|
| 1 | Present | Yes | Cover has been removed | Tamper activated | Enter Service mode |
| 2 | Present | No | Cover has not been removed | Nothing | None |
| 3 | Removed | Yes | No conclusion can be made | Power was removed | None |
| 4 | Removed | No | No conclusion can be made | Power was removed | None |

What is needed is a tamper-detection switch that overcomes the above-noted shortcomings.

SUMMARY

It is, therefore, one aspect of the present disclosure to provide a tamper-detection device and system which reduces the number of false positive events and reduces an attacker's ability to remove the power supplied to the tamper-detection device to circumvent the tamper-detection device.

Specifically, at least one embodiment of the present disclosure contemplates providing a tamper-detection device with a tamper switch, a microcontroller, a diode, and a capacitor. In one aspect of the present disclosure, the capacitor is configured to discharge when the tamper switch of the tamper-detection device moves from one position to another position or from a first state to a second state depending upon the nature of the tamper switch. More specifically, the capacitor discharges even when there is no power being provided to the tamper-detection device. Once power is reapplied, the microcontroller can read its input and determine that the capacitor has discharged. Upon making such a determination, the microcontroller can activate a tamper function causing the device to enter an inoperable or service mode until appropriate inspection and/or service is provided and may also report the tamper activity through a display associated with the device or amenity. In addition, once power is restored, the device or amenity may send a signal to a remote device reporting a potential tamper activity.

It is another aspect of the present disclosure to provide a tamper-detection device which can have its power supply interrupted (e.g., for purposes of changing the power supply) without causing a false tamper detection event to occur. In particular, a tamper-detection device can be provided with a time limited supplemental power supply that maintains the logical value provided to the input of the microcontroller when power is interrupted for a period of time. One way in which this may be accomplished is using a diode, in combination with the capacitor. If the internal leakage of the diode and capacitor are low, the capacitor charge may be held for a sufficiently long period of time to accommodate most, if not all, power interruptions that may lead to false positive situations, such as battery changes, routine maintenance and power surges. By minimizing false positive conditions, the activation of tamper functions can be taken more seriously. Because activation of the tamper function should be a very rare event it should be taken seriously, like a fire alarm. As false alarms will reduce the trustworthiness of the event it is desirable to keep false positive conditions to a minimum.

In accordance with at least some embodiments of the present disclosure a multi-room facility is described which includes one or more devices in one or more of the rooms. The in-room devices may be equipped with a tamper-detection device of the type described herein. The tamper-detection device is configured to detect tamper with the device or amenity in the absence of power being supplied to the microcontroller of the tamper-detection device. Examples of such devices include, but are not limited to, safes, mini-bars, and the door lock for a room.

The Summary is neither intended nor should it be construed as being representative of the full extent and scope of the present disclosure. The present disclosure is set forth in various levels of detail and the Summary as well as in the attached drawings and in the detailed description of the disclosure and no limitation as to the scope of the present disclosure is intended by either the inclusion or non inclusion of elements, components, etc. in the Summary. Additional aspects of the present disclosure will become more readily apparent from the detailed description, particularly when taken together with the drawings.

DETAILED DESCRIPTION

Figure 1:
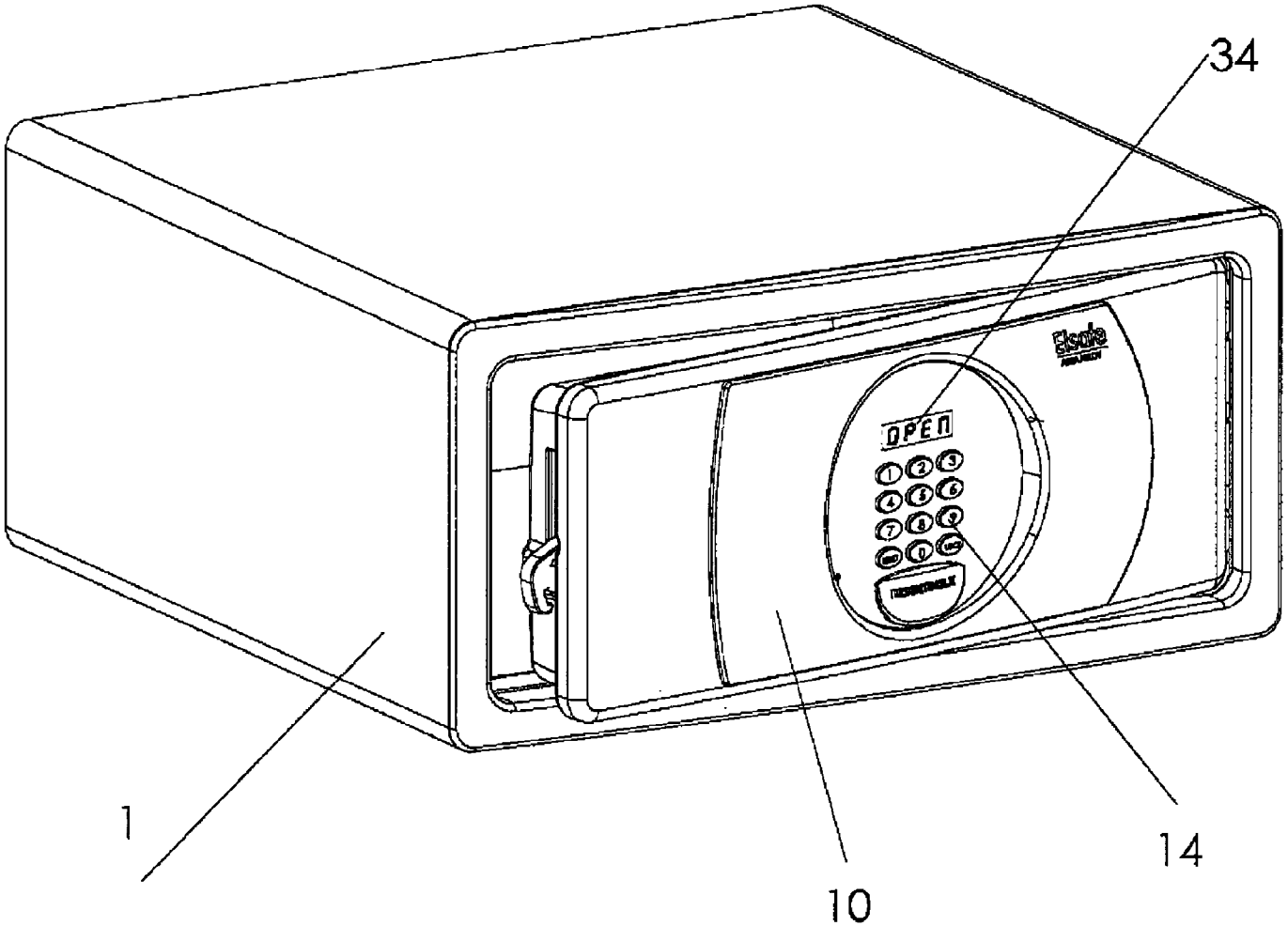
FIG. 1 is a perspective view of a safe with its door open in accordance with at least some embodiments of the present disclosure.
Figure 2:
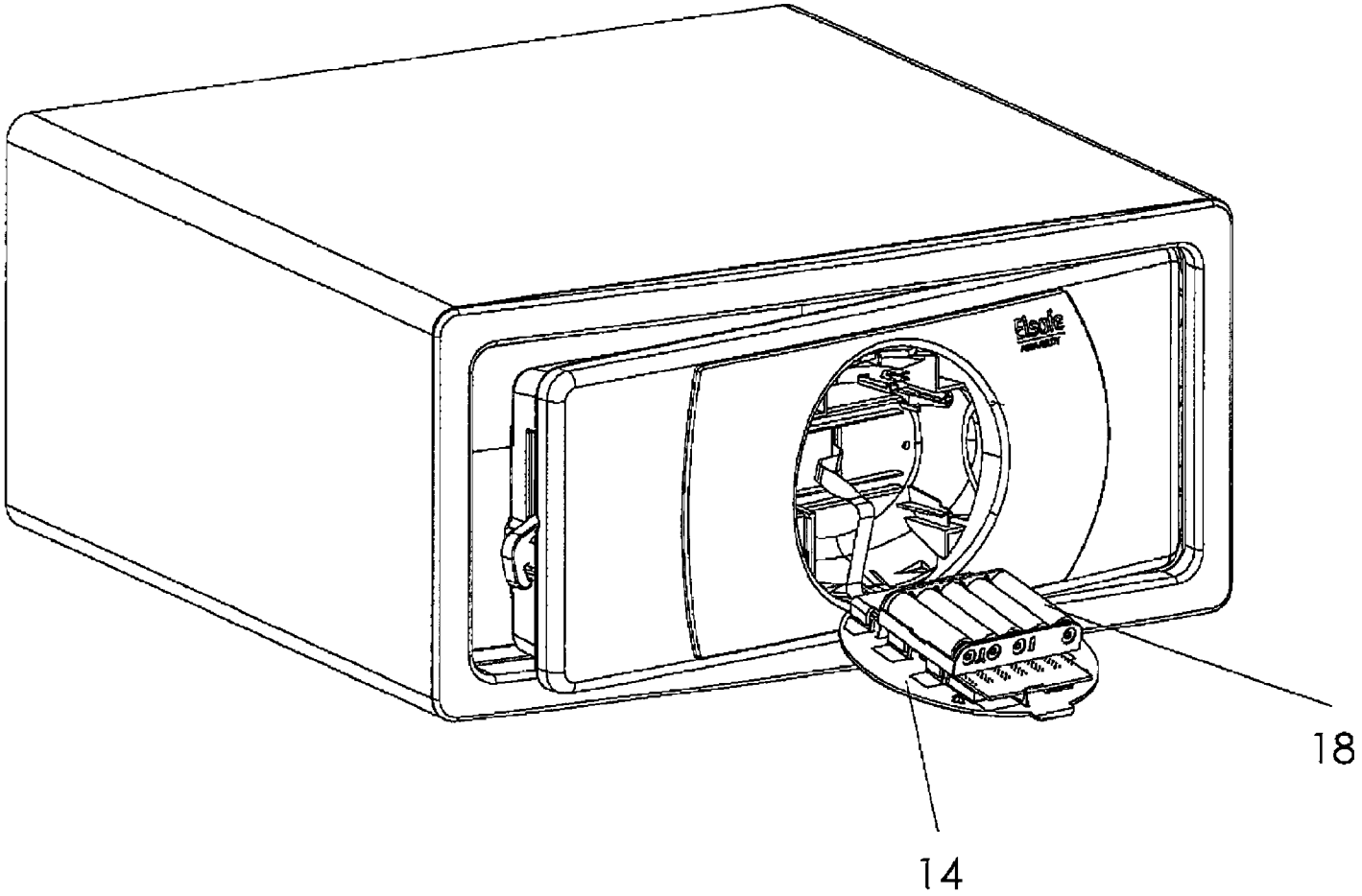
FIG. 2 is a perspective view of a removed user panel in accordance with at least some embodiments of the present disclosure.
Figure 3:
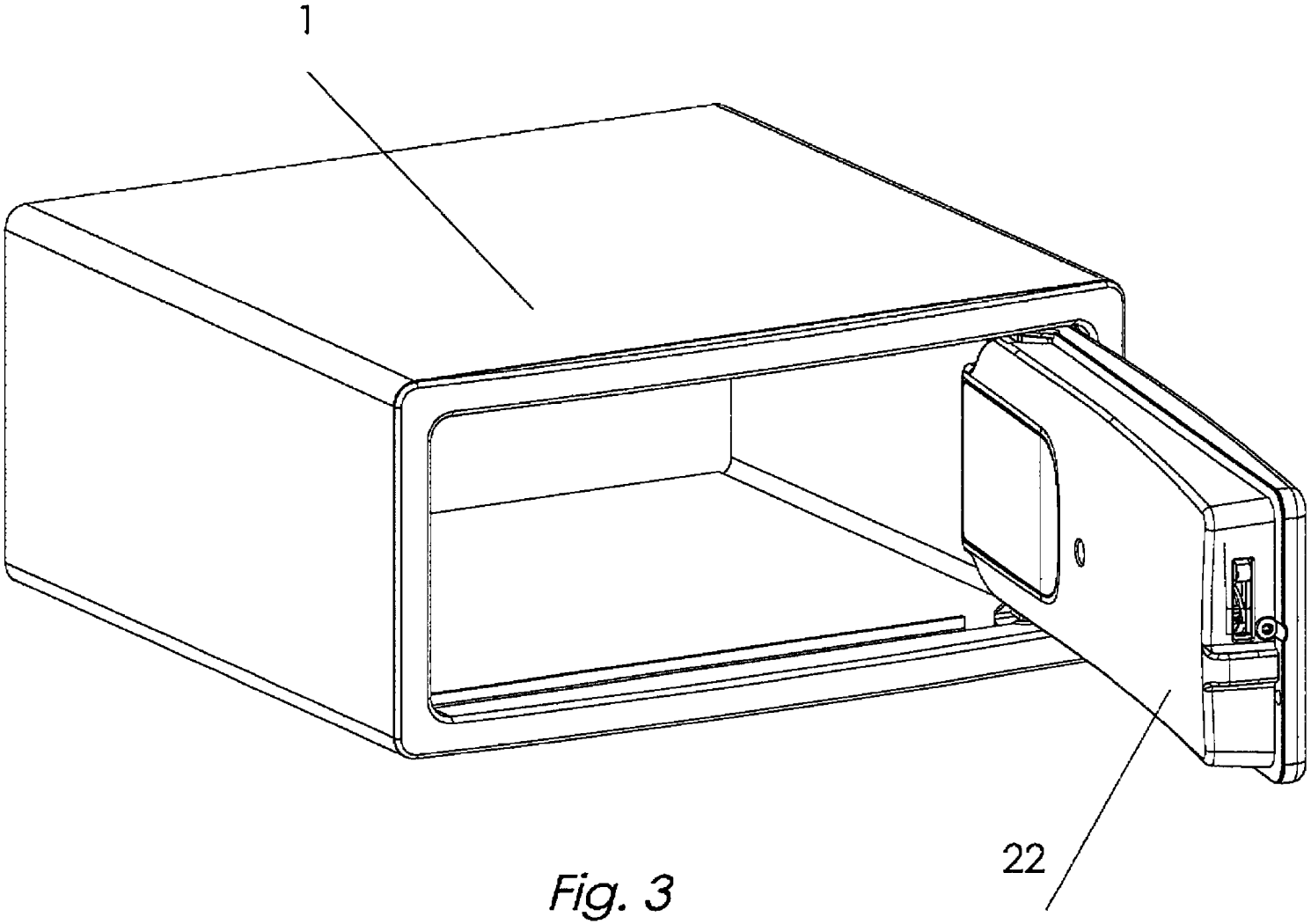
FIG. 3 is a perspective view of a back panel of a safe door in accordance with embodiments of the present disclosure.
Figure 4:
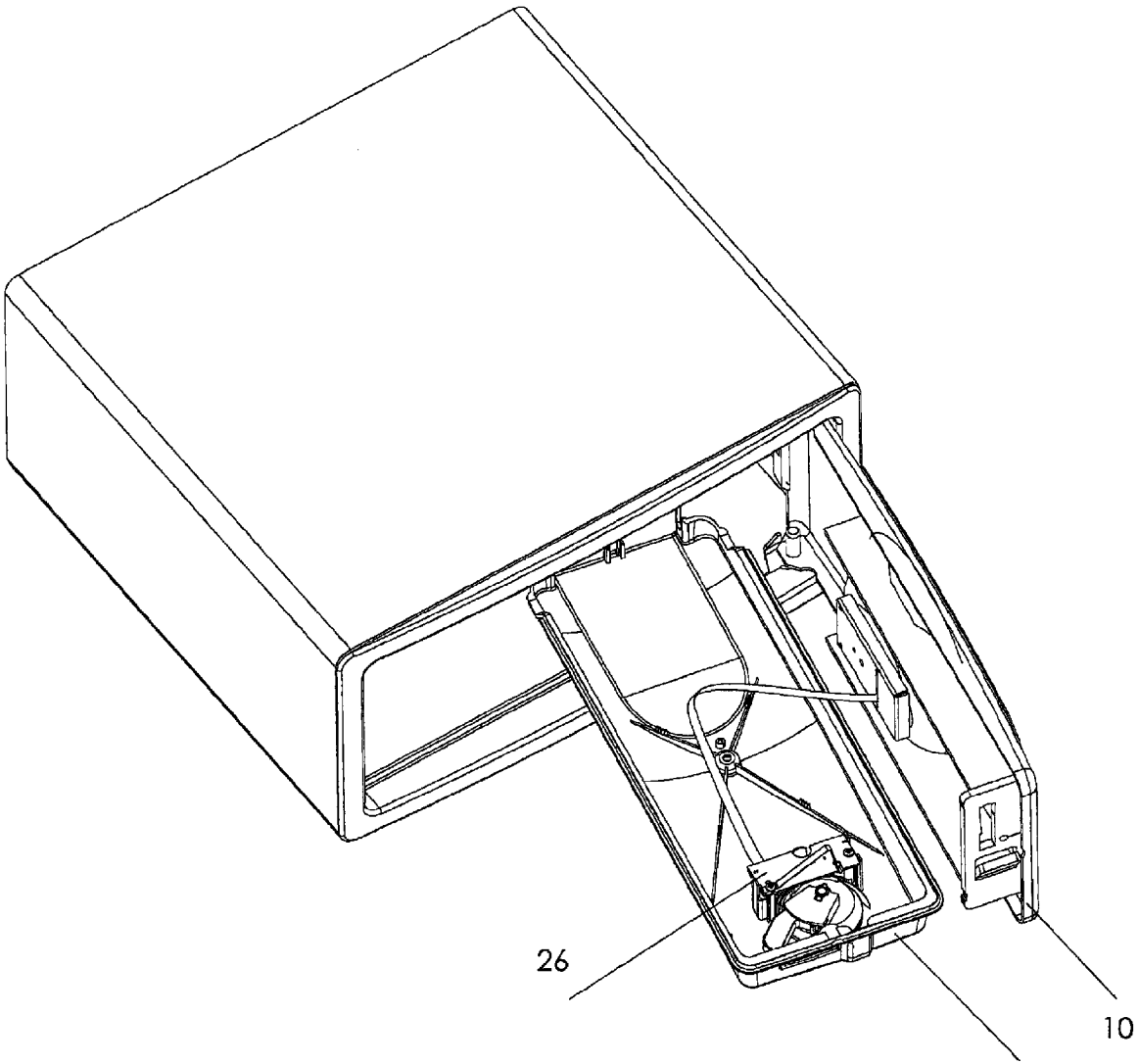
FIG. 4 is a perspective view of an opened back panel of a safe door in accordance with embodiments of the present disclosure.
Figure 5:
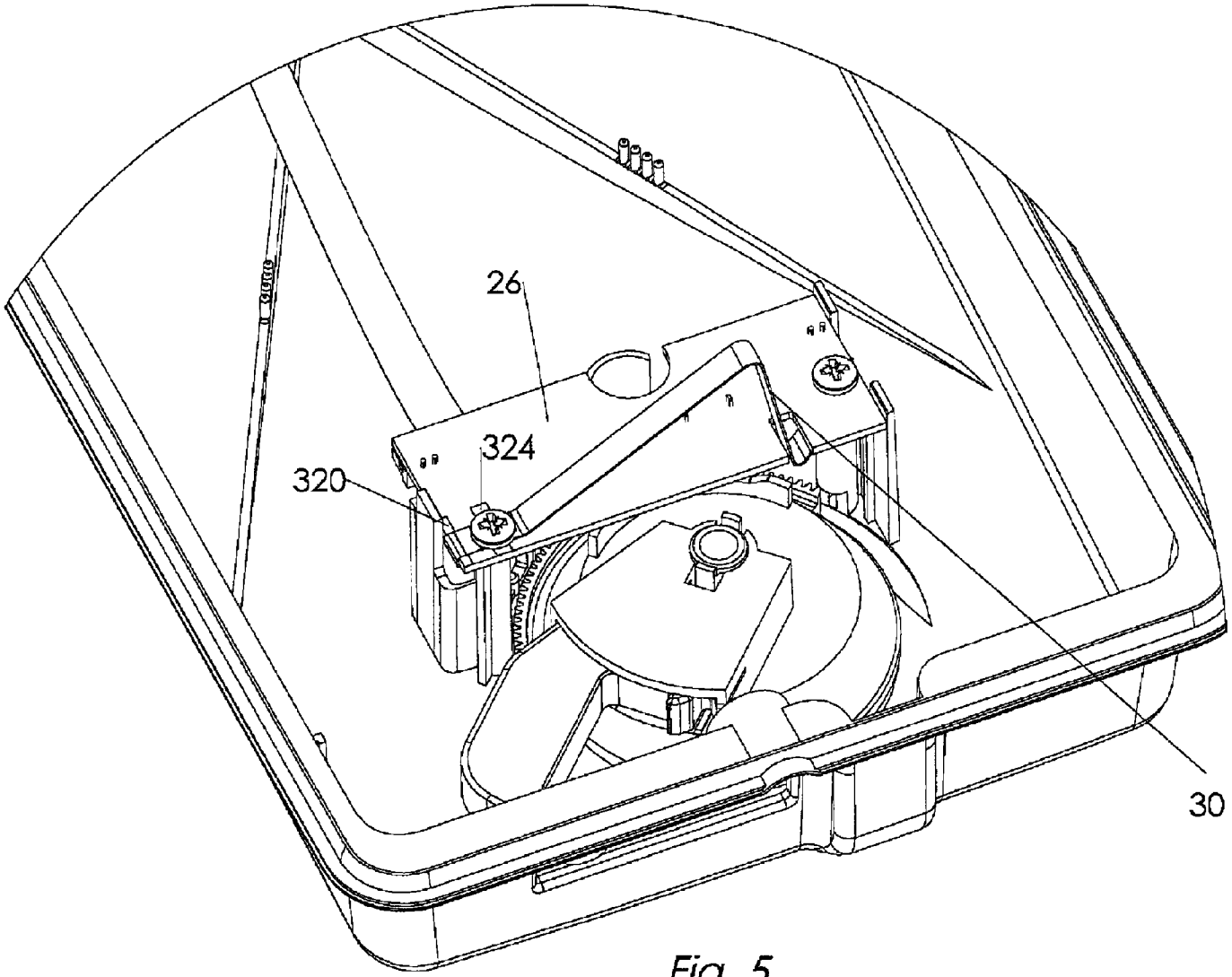
FIG. 5 is a detailed perspective view of the safe electronics in accordance with embodiments of the present disclosure.

The disclosure will be illustrated below in conjunction with an exemplary security system. The exemplary systems and methods of this disclosure will also be described in relation to analysis software, modules, and associated analysis hardware. However, to avoid unnecessarily obscuring the present disclosure, the following description may omit well-known structures, components and devices that may be shown in block diagram form, are well known, or are otherwise summarized.

For purposes of explanation, numerous details are set forth in order to provide a thorough understanding of the present disclosure. It should be appreciated, however, that the present disclosure may be practiced in a variety of ways beyond the specific details set forth herein, all of which are deemed to be within the scope of the present invention.

For exemplary purposes, referring initially to FIGS. 1-5, a safe 1 equipped with a tamper-detection device will be described in accordance with at least some embodiments of the present disclosure. As can be appreciated, any device equipped with a tamper-detection device may either be a stand-alone device or may be connected to a larger security network. In some embodiments, a stand-alone device equipped with the tamper-detection device may enter a "service mode" when tamper activity is detected by the tamper-detection device. A stand-alone device may also display that it has entered the "service mode" through some sort of display associated with the device, thereby alerting potential users and/or security personnel that the device has been tampered. Preferably, when in a "service mode" the device is inoperable. In some embodiments, a networked device may also enter a "service mode" and/or transmit a signal or an alarm to one or more remote devices for purposes of alerting appropriate security personnel.

In the embodiment depicted in FIGS. 1-5, the safe 1 is a stand-alone device equipped with a tamper-detection device. Specifically, the safe 1 comprises a front door 10, a user panel 14 positioned on the front door 10, a power source 18 (which may include a battery pack or similar DC power source), a back panel 22, internal electronics 26, and a tamper switch 30.

The front door 10 may be opened and closed during normal use and the combination for locking the front door 10 may be user-configurable. In some embodiments, a user can enter a code via the user panel 14 to lock and unlock the safe 1 when the safe is operating in a normal mode of operation.

The user panel 14 may also be removable to expose the power source 18 that is used to power some or all components in the internal electronics 26. The internal electronics 26 may be secured in the front door 10 by the back panel 22, which is also removable. However, motion of the back panel 22 relative to the front door 10 may be detected by the tamper switch 30, which may comprise a biased spring or similar mechanical device that is capable of detecting or sensing relative movement between two or more physical objects. Utilization of a mechanical tamper switch 30 is preferred compared to electronic or optical sensors which require substantial power to operate over a period of time. As used in this disclosure, the term switch means any type of device or sensor that detects relative movement between two or more objects and either does not require power to operate or has substantially low power requirements over an extended period of time.

In some embodiments, if the tamper switch 30 detects that the back panel 22 has been removed from the front door 10, the tamper switch 30 may send a signal to a microcontroller included in the internal electronics 26 indicating a tamper event. As will be discussed in further detail herein, the internal electronics 26 may be configured to provide this logical signal to the microcontroller regardless of whether or not the power source 18 is currently providing power to the internal electronics 26.

Upon registering that a tamper event has occurred, the microcontroller may cause the safe 1 to lose some or all of its functionality. In particular, the microcontroller may cause the safe 1 to enter a "service mode" where the user panel 14 is no longer operable in its normal fashion and the front door 10 can no longer be locked to secure items in the safe 1. With the safe in a service mode or otherwise non-functional, guests will not use the device and will likely report the non-functional status to hotel management. The fact that the safe 1 has entered the "service mode" may also be displayed via the user panel 14 or other display 34 associated with the device. The display may display words, such as "Service." Alternatively, a light signal or sound may be used to indicate service mode, for example through a specific color or blinking sequence or combination thereof in one or more LEDs or by generating an audible sound through a speaker or sound emitting device. In a networked device, the microcontroller may generate and send a signal or message to security personnel indicating that tamper activity has been detected.

Figure 6:
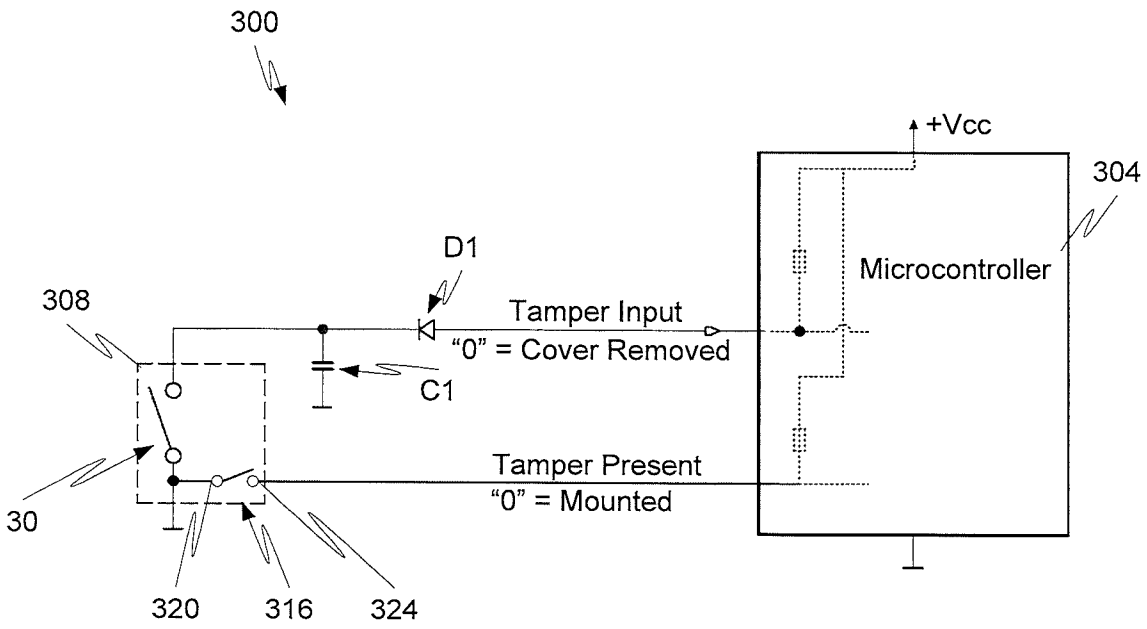
FIG. 6 is a circuit diagram of a tamper-detection switch in accordance with embodiments of the present disclosure.

FIG. 6 depicts circuitry 300 or similar components of a tamper-detection device in accordance with at least some embodiments of the present disclosure. The circuitry 300 may represent some or all of the internal electronics 26 and may include a microcontroller 304, a motion-detection component 308, a first diode D1, and a first capacitor C1. In some embodiments, the motion-detection component 308 comprises at least one physical switch 30 that is configured, for example, to detect movement, opening, and/or closing of a door or panel. The circuitry 300 may also include a second switch 316 that is used to detect whether or not a tamper switch 30 is properly installed or mounted to the printed circuit board (PCB) containing other system circuitry. In particular, the second switch 316 may short two pads 320, 324 on the PCB when the tamper switch 30 is mounted or installed. This shorted value is read by the microcontroller 304 to detect whether the safe 1 is equipped with a tamper switch 30 or not. Thus, when the safe 1 is not equipped with a tamper switch 30, the pads 320, 324 will not be connected and the microcontroller 304 will not try to invoke tamper switch functionality. However, when the safe 1 is equipped with a tamper switch 30, the second switch 316 will be closed and the pads 320, 324 will be connected. This allows the microcontroller 304 to know that a tamper switch 30 is mounted to the PCB and the microcontroller 304 can utilize the input dedicated to the tamper switch 30 to detect tamper events.

In some embodiments, the motion-detection component 308 is provided to monitor one or more security doors/panels that is/are protecting sensitive components of an in-room device. One purpose of the motion-detection component 308 is to detect tamper activity (via detecting activity of switch 30) and switch a logical bit in the microcontroller 304 indicating that tamper activity has been detected. Upon detecting such tamper activity, the microcontroller 304 may then generate a signal or message indicating tamper. Thus, the microcontroller 304 may cause the device to enter a service mode. In addition, a message may be displayed on a display associated with the device indicating the "service mode" status of the device.

In some embodiments, each switch 30, 316 is configured to provide a separate logical value to the microcontroller 304. The first switch 30 provides its logical value to the microcontroller though the diode D1 and capacitor C1 when power is being provided to the circuitry 300. Therefore, a tamper function may be activated when the first switch 30 closes. Activating the tamper function may include providing a logical value (e.g., a logical '0') to the microcontroller 304 which causes the microcontroller 304 to disable one or more functionalities of the device, display a "service mode" or other inoperable condition, and/or report a tamper condition to a remote location, such as a server or other device.

The circuitry (i.e., the diode D1 and capacitor C1) is provided to activate the tamper function (i.e., provide a logical '0' value to the microcontroller 304) even if the circuitry 300 is without power (e.g., batteries). The diode D1 and capacitor C1 act as a time limited self-powered signal source. More specifically, the characteristics of the diode D1 and capacitor C1 may be selected such that if power is interrupted and the security door/panel is removed or opened and then put back or closed, the microcontroller 304 will still eventually receive a logical '0' value indicating tamper. As one non-limiting example, the capacitor C1 may be a low leakage type capacitor (e.g., 10 uF/16V ceramic capacitor) and the diode D1 may be a low leakage type diode (e.g., a diode manufactured and distributed under part number BAS116).

It is the internal leakage of the components (e.g., diode D1 and capacitor C1) that should be low. With the components described herein, the capacitor C1 is capable of holding its charge for days, although only a couple of hours may be required to support battery replacement. In addition, the capacitor C1 may be designed to have a large enough capacitance so that when power is reapplied (after power has been removed and tamper switch 30 activated) it does not recharge above a certain level before it is read by the microcontroller 304. The value of the capacitance of the Capacitor C1 depends on type of microcontroller 304 (e.g., the value of an internal pull-up resistor in the microcontroller 304) and the firmware in the microcontroller 304. By changing the firmware in the microcontroller 304, the value of capacitance required for capacitor C1 can be reduced considerably.

In some embodiments, if the power supply is removed and the first switch 30 is closed, the capacitor C1 will be rapidly discharged. When the power is reapplied, the input at the microcontroller 304 is read as a logical '0' until the capacitor C1 is again charged by the internal pull-up resistor. Reading of the logical '0' during this time enables the microcontroller 304 to report tamper even though there was no power supply when the actual tamper activity occurred. Moreover, even if the security door/panel was replaced before power was reapplied, the capacitor C1 will already have discharged and the microcontroller 304 will still read the logical '0'.

In some embodiments, when the microcontroller 304 detects tamper, a tamper function may be activated where the microcontroller 304 disables further use of the in-room device (e.g., safe 1, door lock, mini-bar, etc.) protected by the tamper switch 30 until an authorized person, such as a system administrator, addresses the situation and resets the system. Furthermore, the microcontroller 304 may store activation of the tamper function in an event log that is either stored locally at the protected device or elsewhere.

The result of including the circuitry (i.e., diode D1 and capacitor C1) is that tamper activity detected at the motion-detection component 308 will always be reported to the microcontroller 304 when the switch 30 is moved from its normal position, regardless of whether or not power is being provided to the microcontroller 304 at the time of the tamper activity.

Of course, if the power is removed for a prolonged period of time (e.g., several hours or more), the capacitor C1 will eventually discharge due to the small internal leakage currents in the capacitor C1, diode D1, and the surface of the PCB onto which other components are mounted. In this rare situation, the microcontroller 304 will detect tamper, even if the motion-detection component 308 has not been activated. Thus, when power is restored, the microcontroller 304 will cause the device to enter a service mode. It should be noted, however, that leaving the circuitry 300 without power for a prolonged period is uncommon.

Figure 7:
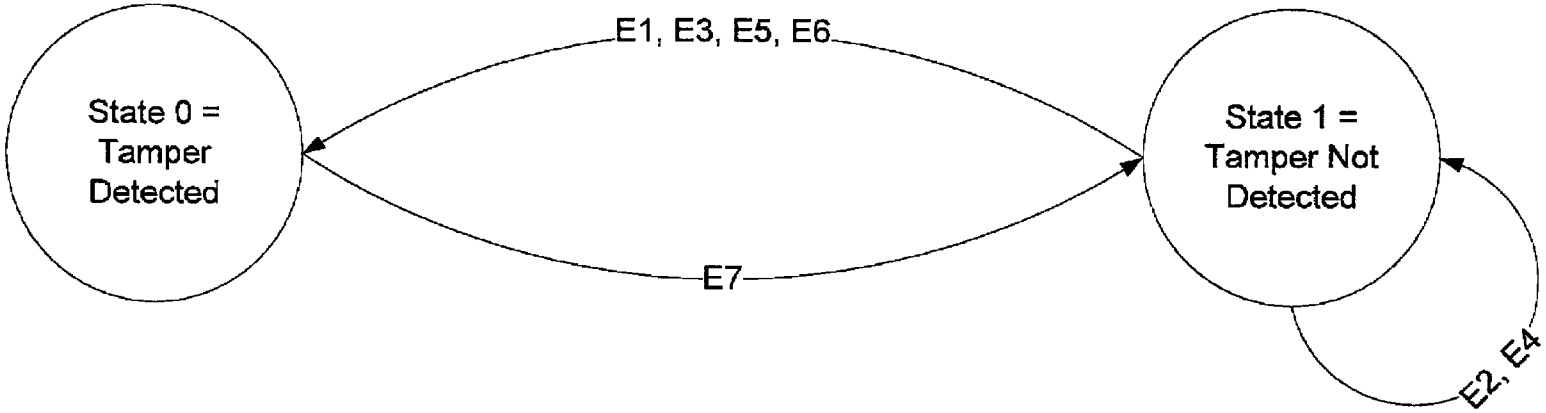
FIG. 7 is a state diagram depicting the various states and conditions that can be detected with a tamper-detection switch according to embodiments of the present disclosure.

With reference now to FIG. 7, a state diagram depicting the various state events which can result in a state change at the microcontroller 304 will be described in accordance with at least some embodiments of the present disclosure. More specifically, the examples depicted in FIG. 7 show that a logical '0' corresponds to a tamper detection state and a logical '1' corresponds to a normal state. It should be appreciated, however, that the logical values used for the various states described herein can be reversed without departing from the scope of the present disclosure. The various events, sequence of events, or conditions are depicted in FIG. 7 as events E1-E7. Details of each event are described more fully below.

Event E1—Corresponds to a condition where the security door/panel is removed when power is available to the circuitry 300. When this event occurs, the capacitor C1 is shorted due to the first switch 30 closing and the input of the microcontroller 304 changes from a logical '1' to '0'.

Event E2—Corresponds to a condition where the security door/panel is not removed when power is fully available to the circuitry 300. When this event occurs, the capacitor C1 holds its charge and the input of the microcontroller 304 remains a logical '1'.

Event E3—Corresponds to a condition where the security door/panel is removed when power is interrupted, but the capacitor C1 is still charged (i.e., has not discharged due to a prolonged power interruption). When this event occurs, the capacitor C1 is shorted by the first switch 30 and the input of the microcontroller 304 changes from a '1' to a '0'. As the microcontroller 304 is now without power, it cannot read the input and report the tamper situation. However, once power is restored, the microcontroller 304 reads the input as '0' and the tamper function can be activated.

Event E4—Corresponds to a condition where power is interrupted and the security door/panel is not removed. When this event occurs, the capacitor C1 keeps its charge. As the microcontroller 304 is now without power it cannot read its input or perform any normal functions. Once the power is restored, the microcontroller reads the input as '1' and no tamper function is activated.

Event E5—Corresponds to a condition where the security door/panel is removed when power is interrupted for a long time, and the capacitor C1 has little or no charge. As the microcontroller 304 is now without power it cannot read its input. Once the power is restored, the microcontroller 304 reads the input as a logical '0'.

Event E6—Corresponds to a condition where the security door/panel is not removed when power is interrupted for a long time, and the capacitor has little or no charge. As the microcontroller 304 is now without power it cannot read its input. Once the power is restored, the microcontroller 304 reads the input as a logical '0'.

Event E7—Corresponds to a condition where a system administrator resets the tamper switch 30. This usually requires the use of a service device and an authorized person to present the service device to the device protected by the tamper switch 30.

It should be noted that events E5 and E6 occur very rarely. Events E1, E3, E5, and E6 correspond to events which can change the state detected by the microcontroller 304 from a normal state to a tamper detected state. Event E7 corresponds to an event which changes the state detected by the microcontroller 304 from a tamper detected state to a normal state. This may also be the only way to get the tamper-detection device 232 to exit the "service mode" where its functionality is limited or completely unavailable. Events E2 and E4 correspond to events which to not change the state of the microcontroller 304.

Advantages of utilizing this design which leverages a capacitor C1 to discharge upon detecting tamper activity are many. First of all, the activation of the motion-detection component 308 will always be detected, even in situations where the tamper switch 30 is activated during a period of power interruption. Another significant advantage is that the power supply (e.g., batteries) can be replaced without triggering the tamper function (i.e., without changing the state of the microcontroller 304). In most normal situations, the in-room device will only be without power when batteries are being changed. Thus, the number of false positive conditions can be reduced. If the activation of the tamper function is reported by the microcontroller 304, the reporting of such an event can be taken seriously since false positive conditions only occur in rare circumstances.

While the above-described state diagram has been discussed in relation to a particular sequence or set of events, it should be appreciated that changes to this sequence or set can occur without materially effecting the operation of the disclosure. Additionally, the exact sequence of events need not occur as set forth in the exemplary embodiments. The exemplary techniques illustrated herein are not limited to the specifically illustrated embodiments but can also be utilized with the other exemplary embodiments and each described feature is individually and separately claimable.

The present disclosure, in various embodiments, includes components, methods, processes, systems and/or apparatus substantially as depicted and described herein, including various embodiments, subcombinations, and subsets thereof. Those of skill in the art will understand how to make and use the present disclosure after understanding the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

Additionally, the systems, methods and protocols of this disclosure can be implemented on a special purpose computer, a programmed microprocessor or microcontroller and peripheral integrated circuit element(s), an ASIC or other integrated circuit, a digital signal processor, a hard-wired electronic or logic circuit such as discrete element circuit, and a programmable logic device such as PLD, PLA, FPGA, PAL. In general, any device capable of implementing a state machine that is in turn capable of implementing the methodology illustrated herein can be used to implement the various communication methods, protocols and techniques according to this disclosure.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover though the description of the disclosure has included description of one or more embodiments and certain variations and modifications, other variations and modifications are within the scope of the disclosure, e.g., as may be within the skill and knowledge of those in the art, after understanding the present disclosure. For example, embodiments of the invention may be used with locks associated with doors, such as hotel room doors or access doors to devices or amenities other than safes to detect tampering. In these alternative end uses, the result of detecting or sensing a tamper event may cause the lock to either lock or disable the lock mechanism, depending upon the specific circumstances involved. An authorized person would be needed to restore the lock to normal operating condition. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A tamper-detection device, comprising:

a tamper switch moveable between a first position and a second position, wherein the first position corresponds to a normal position of the tamper switch and the second position corresponds to a tamper-detected position;

a microcontroller connected to the tamper switch, wherein the microcontroller is configured to receive an input that indicates whether the tamper switch is in the first position or the second position;

a capacitor connected between the tamper switch and microcontroller, the capacitor being configured to discharge when no power is being provided to the microcontroller and the tamper switch moves from the first position to the second position; and a second switch connected between the tamper switch and the microcontroller, wherein the second switch is configured to set a logical value at the microcontroller representing whether or not the tamper switch is installed.

2. The tamper-detection device of claim 1, wherein the input is configured to be read by the microcontroller after power is reapplied to the microcontroller.

3. The tamper-detection device of claim 1, wherein the microcontroller is further configured to activate a tamper function upon reading a discharged state of charge of the capacitor.

4. The tamper-detection device of claim 3, wherein the microcontroller is further configured to disable at least some functionality of a device equipped with the tamper-detection device when the microcontroller recognizes activation of the tamper function.

5. The tamper-detection device of claim 4, further comprising a display, wherein upon at least some functionality of the device equipped with the tamper-detection device being disabled, a message or signal relating to the disabled functionality is displayed on the display.

6. A safe equipped with the tamper-detection device of claim 1.

7. A lock equipped with the tamper-detection device of claim 1.

8. The tamper-detection device of claim 1, wherein the capacitor is discharged providing the input to the microcontroller such that when power is later provided to the microcontroller, the microcontroller is capable of determining that the tamper switch was in the second position while no power was provided to the microcontroller.

9. The tamper-detection device of claim 1, wherein the microcontroller is configured to disable a functionality of a device associated with the tamper-detection device, upon determining that the tamper switch was in the second position.

10. The tamper-detection device of claim 1, wherein the microcontroller is configured to generate and issue a message upon determining that the tamper switch was in the second position.

11. The tamper-detection device of claim 1, wherein the capacitor is further configured to maintain the input provided to the microcontroller when no power is being provided to the microcontroller as long as the capacitor has a charge and the tamper switch stays in the first position.

12. The tamper-detection device of claim 1, wherein the capacitor is connected in parallel between the tamper switch and microcontroller.

13. A safe equipped with the tamper-detection device of claim 1.

14. A lock equipped with the tamper-detection device of claim 1.

15. The tamper-detection device of claim 1, further comprising:

a signal generating device/circuit having time limited self-powering capability to generate and send a signal to the microcontroller reporting the tamper switch has changed states while no power is supplied to the microcontroller.

16. The tamper-detection device of claim 15, wherein the signal generating device/circuit is a capacitor in series with a diode.

* * * * *